US006834489B2

(12) United States Patent
Pyra et al.

(10) Patent No.: US 6,834,489 B2
(45) Date of Patent: Dec. 28, 2004

(54) FALSE TWIST TEXTURING APPARATUS

(75) Inventors: Michael Pyra, Brüggen (DE); Klemens Jaschke, Hückeswagen (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/717,840

(22) Filed: Nov. 20, 2003

(65) Prior Publication Data

US 2004/0098964 A1 May 27, 2004

Related U.S. Application Data

(63) Continuation of application No. PCT/EP02/06845, filed on Jun. 20, 2002.

(30) Foreign Application Priority Data

Jun. 23, 2001 (DE) ..... 101 30 389

(51) Int. Cl.[7] ..... D01H 13/26; D02G 1/04
(52) U.S. Cl. ..... 57/291; 57/284; 57/288
(58) Field of Search ..... 57/282–292

(56) References Cited

U.S. PATENT DOCUMENTS

| | | | | |
|---|---|---|---|---|
| 3,999,360 A | | 12/1976 | Forin et al. | |
| 4,395,872 A | * | 8/1983 | Riedl | 57/291 |
| 6,209,302 B1 | * | 4/2001 | Wortmann et al. | 57/290 |
| 6,430,911 B1 | * | 8/2002 | Jaschke et al. | 57/261 |
| 6,487,842 B2 | * | 12/2002 | Tanae et al. | 57/284 |

FOREIGN PATENT DOCUMENTS

| | | | | |
|---|---|---|---|---|
| AU | 61240 99 A | | 5/2000 | |
| EP | 0 641 877 A2 | | 3/1995 | |
| EP | 0 659 913 B1 | | 6/1995 | |
| EP | 0 763 612 A2 | | 3/1997 | |
| EP | 1 136 601 A1 | | 9/2001 | |
| JP | 60 021931 A | | 2/1985 | |
| JP | 2000355840 A | * | 12/2000 | D02G/1/02 |

* cited by examiner

*Primary Examiner*—John J. Calvert
*Assistant Examiner*—Shaun R Hurley
(74) *Attorney, Agent, or Firm*—Alston & Bird LLP

(57) ABSTRACT

A false twist texturing apparatus for false twist texturing a plurality of synthetic yarns in a plurality of processing stations, which each comprise a plurality of feed roll systems, a primary heater, a cooling device, a false twist unit, a secondary heater, and a takeup device. For accommodating the takeup devices, a takeup module is provided, and a processing module is provided for accommodating the false twist units, with a doffing aisle being formed along the takeup module and a servicing aisle along the processing module. To realize a short yarn path, the processing module and the takeup module are joined to form a frame section arranged between the servicing aisle and the doffing aisle. In this arrangement, the yarn passage from the processing module to the takeup module is formed by the secondary heater which is horizontally oriented, so that the yarn is guided between the false twist unit and the takeup device on the frame section along a generally U-shaped path.

9 Claims, 2 Drawing Sheets

FALSE TWIST TEXTURING APPARATUS

CROSS-REFERENCE TO RELATED APPLICATION

This application is a continuation of International Patent Application PCT/EP02/06845 filed Jun. 20, 2002, and which designates the United States. The disclosure of the referenced application is expressly incorporated herein by reference.

BACKGROUND OF THE INVENTION

The present invention relates to a false twist texturing apparatus for false twist texturing a plurality of synthetic yarns, of the general type disclosed in EP 0 641 877 and corresponding U.S. Pat. No. 5,644,908.

Such false twist texturing machines comprise a plurality of processing stations, which are arranged in side by side relationship along the longitudinal side of the machine. Each of the processing stations includes a plurality of feed roll systems as well as a primary heater, a cooling device, a false twist unit, a secondary heater, and a takeup device.

Basically, a difference is made between two types of false twist texturing machines. In a first type, on which the invention is based, the packages wound in the takeup device are automatically doffed and automatically removed by doffers. To this end, the false twist texturing machine as disclosed in the above patents includes a separate doffing aisle, which permits removing the fully wound packages. The doffing aisle extends along one side of a takeup module, which accommodates the takeup devices. For operating the processing units in the false twist texturing machine, a separate servicing aisle is provided, which extends along the opposite side of the takeup module and between the takeup module and a processing module.

In a second type of false twist texturing machine, the packages wound in the takeup device are manually doffed. False twist texturing machines of this type as disclosed, for example, in EP 0 659 913 comprise a single servicing aisle for purposes of enabling both the package doff and the operation of the processing units by one operator. For this reason, false twist texturing machines of this type are totally unsuited for enabling an automatic removal of the wound packages.

When both a servicing aisle and a separate doffing aisle are employed, the processing units of the first type of false twist texturing machines are arranged in such a manner that the yarn traverses the servicing aisle several times, which leads to a plurality of yarn deflections.

It is therefore an object of the invention to further develop the false twist texturing machine of the first type in such a manner that a shortest possible yarn path results with the least possible yarn deflections.

SUMMARY OF THE INVENTION

In accordance with the invention, the above and other objects and advantages are achieved by positioning the processing module and the takeup module so that they are joined to form a frame section arranged between the servicing aisle and the doffing aisle, and so that the passage of the yarn from the processing module to the takeup module is formed by a generally horizontally oriented secondary heater. Further, the yarn advances in the frame section between the false twist unit and the takeup device along a generally U-shaped path, with the secondary heater being located at the base of the u-shaped path.

The invention distinguishes itself by a very compact construction and by a very stable threadline. The passage of the yarn between the processing module and the takeup module is used as a set zone, in which the heat treatment of the yarn occurs by means of the secondary heater. As a result, additional yarn deflections can advantageously be avoided.

A preferred further development of the invention has the advantage that it prevents a crossing yarn path in the false twist texturing machine. To this end, the processing module is associated on the opposite side of the servicing aisle with a feed module for accommodating a withdrawal roll system. The passage of the yarn from the feed module to the processing module is formed by the primary heater and the cooling device, which are arranged above the servicing aisle in such a manner that the yarn advances from the withdrawal roll system to the false twist unit along a substantially inverted V-shaped path. With the compact construction of the modules, it is possible to realize a very long false twist zone for tempering and subsequently cooling the yarn.

During the heat aftertreatment in the set zone, the yarn advances under very little tension, so as to enable a shrinkage treatment of the yarn in the set zone. However, this makes it necessary that the guidance of the yarn ensure a uniform tempering of the yarn within the secondary heater. In this connection, it has been found that the use of a contact heater is possible, in particular as a result of a further development of the invention wherein the secondary heater is placed on the underside of the frame section, so that after passing through the processing module, the yarn can be transferred directly to the takeup module.

With the use of a contact heater, the secondary heater is arranged with an inclination, preferably in an angular range from about 5° to about 45°.

To avoid additional yarn guide elements, the processing module mounts one of the feed roll systems between the false twist unit and the secondary heater in such a manner that the yarn outlet of the feed roll system and the yarn inlet on the secondary heater are aligned with each other in facing relationship.

Similarly, a further feed roll system is arranged on the takeup module below the takeup device in such a manner that the yarn inlet of the feed roll system and the yarn outlet of the secondary heater are aligned in facing relationship.

In this arrangement, the yarn deflection is realized in an advantageous manner by a feed roll system, which is formed by a godet that is looped by the yarn several times, and with a yarn guide roll associated therewith. In this connection, the yarn inlet on the secondary heater and the yarn outlet on the secondary heater are each arranged in tangential relationship with the godets of the feed roll systems. There are no yarn guide elements between the feed roll systems and the secondary heater.

To ensure an easy operability despite the high integration of the modules, in particular when threading the yarn, a further development of the invention provides a heating channel in the secondary heater which connects to an injector, which is designed to permit an automatic threadup of the yarn through the heating channel. For a further automation, it is also proposed to associate a further injector of a threading device with the yarn outlet of the secondary heater, with the threading device guiding the yarn as far as the takeup device.

To enable in the false twist zone an unimpeded return of the false twist into the primary heater, an advantageous further development of the invention provides that the primary heater and the cooling device are arranged in a generally linear arrangement above the servicing aisle. With that, it is possible to realize intensive crimps in the yarn.

In cases which do not require a heat aftertreatment of the yarn, it would be possible, for purposes of maintaining the yarn path, to replace the secondary heater with a guide tube of the threading device.

BRIEF DESCRIPTION OF THE DRAWINGS

In the following, the invention is described in greater detail with reference to a preferred embodiment and with reference to the attached drawings, in which.

DETAILED DESCRIPTION OF THE PREFERRED EMBODIMENT

Figure 1:
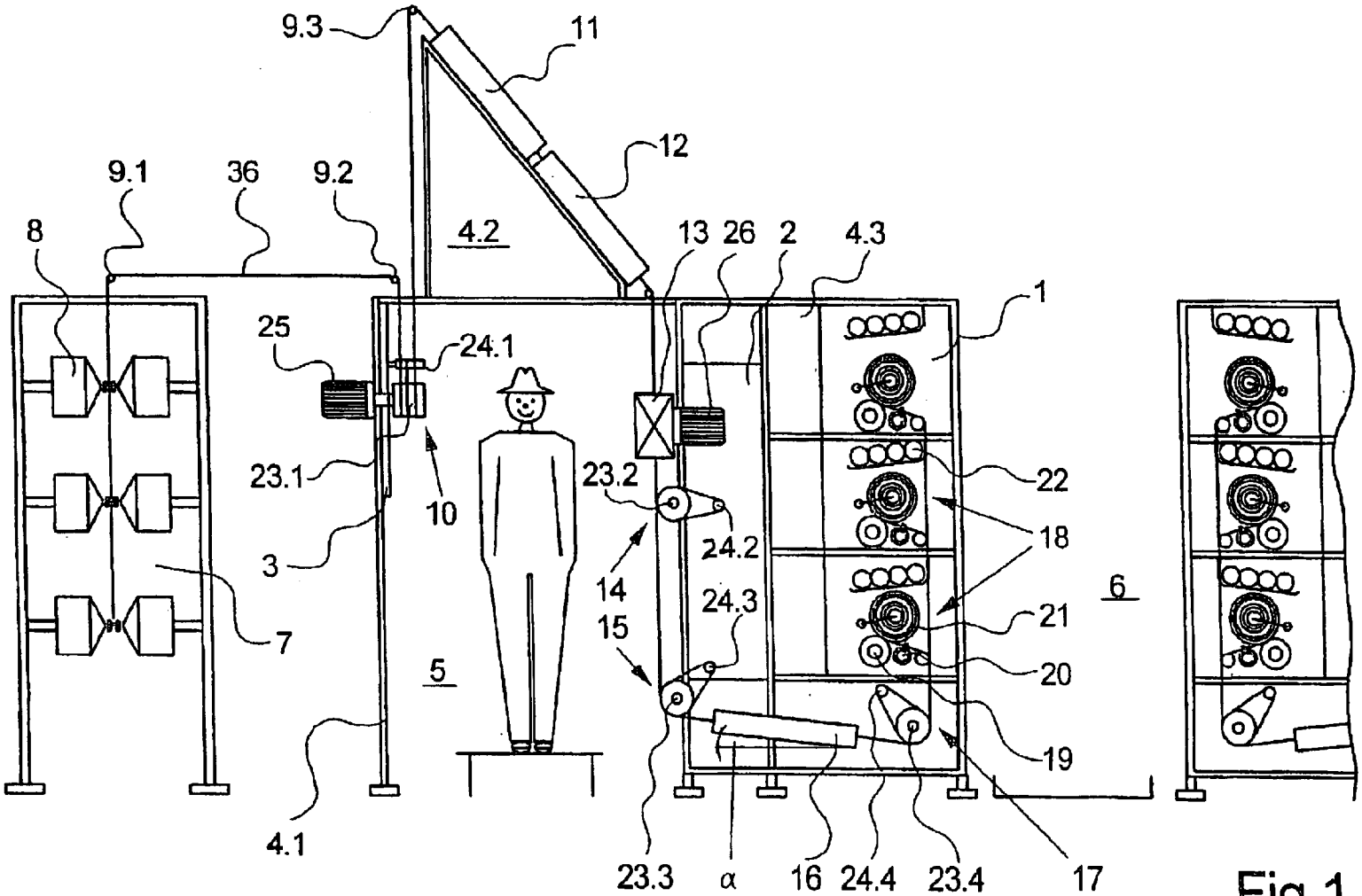
FIG. 1 is a schematic view of an embodiment of the false twist texturing machine according to the invention.

FIG. 1 schematically illustrates a first embodiment of a false twist texturing machine according to the invention. The false twist texturing machine comprises a feed module 3, a processing module 2, and a takeup module 1, which are arranged in a machine frame with frame sections 4.1, 4.2, and 4.3. The feed module 3 is supported by frame section 4.1, and the processing module 2 and takeup module 1 by frame section 4.3. The frame section 4.1 and the frame section 4.3 are interconnected by frame section 4.2, which is arranged above feed module 3 and processing module 2. Between the processing module 2 and feed module 3, a servicing aisle 5 is formed below frame section 4.2.

In the frame section 4.2, the processing module 2 is arranged on the side facing servicing aisle 5, and the takeup module 1 on the side opposite thereto. Along the right side of the takeup module 1 as illustrated, a doffing aisle 6 is provided. Associated with doffing aisle 6 is a second takeup module 1 of a second false twist texturing machine, which is arranged in mirror symmetry with the first false twist texturing machine. This arrangement makes it possible to transfer packages from two machines to one removal device and to transport them away through the doffing aisle.

In its longitudinal direction (in FIG. 1, the plane of the drawing corresponds to the transverse plane) the false twist texturing machine comprises a plurality of side by side processing stations, with one yarn being processed per processing station. The takeup devices 18 occupy a width of three processing stations. For this reason, as will be dealt with further below, three takeup devices 18 are each arranged one above the other in a column in takeup module 1.

Each processing station includes a withdrawal roll system 10, which is mounted on feed module 3. Associated with the withdrawal roll systems 10 of adjacent processing stations is a creel 7, which accommodates a plurality of feed yarn packages 8 for withdrawing yarns 36. One feed yarn package 8 is associated with each withdrawal roll system 10. The yarn 36 is withdrawn by withdrawal roll system 10 via a plurality of yarn deflection guide rolls 9.1, 9.2, and 9.3.

With reference to the advance of yarn 36, the further components of a processing station will now be described. In the direction of the advancing yarn downstream of withdrawal roll system 10, an elongate primary heater 11 extends, through which yarn 36 advances and, in so doing, is heated to a certain temperature. The primary heater 11 could be constructed as a high-temperature heater, in which the heating surface temperature is above 300° C.

In the direction of the advancing yarn downstream of primary heater 11, a cooling device 12 is provided. The primary heater 11 and cooling device 12 are successively arranged in one plane, and supported by frame section 4.2 above servicing aisle 5. In the inlet region of primary heater 11, a deflection guide roll 9.3 is arranged, so that the yarn 36 crosses servicing aisle 5 along an inverted V-shaped path.

On the side of servicing aisle 5 opposite to feed module 3, the processing module 2 of the frame section 4.3 is positioned. In the direction of the advancing yarn, the processing module 2 accommodates, one below the other, a false twist unit 13, a draw roll system 14, and a set roll system 15. The yarn 36 advances from the outlet end of cooling device 12, which is preferably formed by a cooling rail, to false twist unit 13. The false twist unit 13 is conventional, and may be formed, for example, by a plurality of overlapping friction disks which are driven by a drive 26. Preferably, an electric motor is used as false twist drive 26, which is also arranged on processing module 2.

The draw roll system 14 withdraws the yarn 36 from the false twist zone, which is formed between the false twist unit 13 and withdrawal roll system 10. The draw roll system 14 and withdrawal roll system 10 may be driven at differential speeds for drawing the yarn 36 in the false twist zone.

Arranged downstream of draw roll system 14 is set roll system 15, which guides the yarn 36 directly into a secondary heater 16. To this end, the secondary heater 16 is arranged on the underside of frame section 4.3 and thus below processing module 2 and takeup module 1. The secondary heater 16 forms the yarn passageway from processing module 2 to takeup module 1.

As a result of integrating processing module 2, secondary heater 16, and takeup module 1 in frame section 4.3, a very short yarn path is realized, which is substantially U-shaped. To this end, the underside of takeup module 1 mounts a feed roll system 17, which withdraws yarn 36 from secondary heater 16, and guides the yarn 36 after deflecting it to a takeup device 18. The set roll system 15 and feed roll system 17 are driven at differential speeds so as to enable a shrinkage treatment of yarn 36 within secondary heater 16. In this case, the secondary heater 16 may be formed by a biphenyl heated contact heater. To this end, the secondary heater 16 is inclined relative to the horizontal by an angle $\alpha$, which ranges from about 5° to about 45°. This ensures that within a heating channel of secondary heater 16, the yarn 36 is imparted a uniform heating that is effected by contact.

In the present embodiment, the takeup device 18 is schematically indicated by a yarn traversing device 20, a drive roll 19, and a package 21. In addition, the takeup device 18 includes a tube magazine 22 for performing an automatic package doff. Auxiliary devices that are needed for doffing the full packages are not shown in greater detail.

In their construction, the feed roll systems 10, 14, 15, and 17 are identical, so that in the following their construction is described in greater detail with reference to the example of withdrawal roll system 10. Each feed roll system is formed by a godet 23.1, 23.2, 23.3, 23.4 and a guide roll 24.1, 24.2, 24.3, 24.4 associated therewith. The godet 23.1 is driven via a godet drive 25. Preferably, the godet drive 25 is an electric motor. Each guide roll is supported for free rotation, with the yarn 36 being guided over the godet and guide roll by looping thereabout several times.

Figure 2:
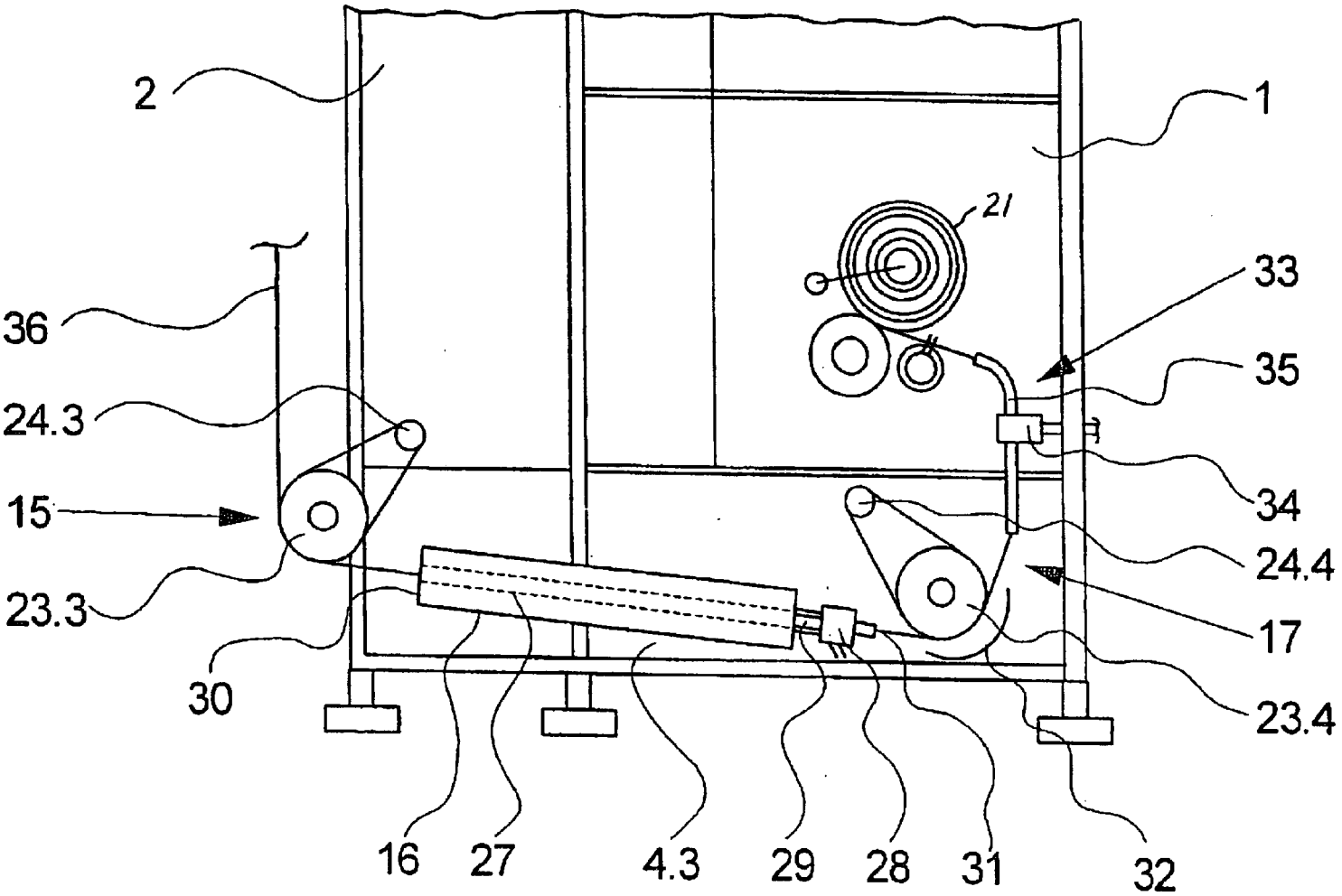
FIG. 2 is a schematic view of a cutout of a further embodiment of a false twist texturing machine according to the invention.

FIG. 2 is a schematic cutout view of a further embodiment of a false twist texturing machine. The cutout shows the yarn passage from processing module 2 to takeup module 1, as could be integrated, for example, in the machine shown in FIG. 1.

In this embodiment, a heating channel 27 of the secondary heater 16 connects to an injector 28. The injector 28 is attached to a guide tube 29, which forms a yarn outlet 31 of secondary heater 16. Opposite to yarn outlet 31 is feed roll system 17. After exiting from outlet 31, the yarn is tangent to godet 23.4.

A yarn inlet 30 of secondary heater 16 is arranged in alignment with the path of the yarn leaving godet 23.3 of set roll system 15. Thus, the guidance of yarn 36 is formed directly upstream of secondary heater 16 by set roll system 15 and directly downstream of the secondary heater by feed roll system 17.

On takeup module 1, a threading device 33 is provided, which includes at least one guide tube 35 and an injector 34. The inlet of guide tube 35 is associated with the yarn outlet 31 of secondary heater 16. The opposite outlet of guide tube 35 faces the takeup device 18, with the injector 34 generating a suction effect at the yarn inlet of guide tube 35, and a blowing effect at the yarn outlet of guide tube 35.

FIG. 2 shows the false twist texturing machine in its operating state, wherein the yarn 36 advances after looping several times about set roll system 15, through secondary heater 16, and is subsequently guided to takeup device 18 by means of feed roll system 17 after looping thereabout several times. In the takeup device, the yarn 36 is wound to a package 21.

For threading the yarn, the injector 28 is activated, so that a suction effect is generated at the yarn inlet of secondary heater 16, and a blowing effect at the end of guide tube 29. Likewise activated is the injector 34 of threading device 33. Between the yarn outlet 31 of secondary heater 16 and the yarn inlet of guide tube 35, a deflection plate 32 is arranged. For threading the yarn 36, same is guided with the use of a catching gun and cut directly upstream of yarn inlet 30 of secondary heater 16. In this process, the yarn 36 is taken by the suction effect into the heating channel 27 of secondary heater 16 and blown out from yarn exit 31 at the opposite end. In so doing, the feed roll system 17 is first bypassed, in that the loose yarn end is guided toward deflection plate 32 and received by the yarn inlet of guide tube 35. As soon as the yarn is guided in guide tube 35, it is threaded on feed roll system 17. For threading the yarn 36 in takeup device 18, the yarn is ejected from the outlet end of guide tube 35, and received and caught by an auxiliary device not shown, so that the yarn can be wound.

The embodiment shown in FIG. 2 ensures the serviceability of secondary heater 16 even despite its nested type of construction in a machine frame.

The embodiments shown in FIGS. 1 and 2 are exemplary for the construction of the individual processing units. Basically, it is possible to replace individually driven godets with nip-type feed roll systems with a common drive. Important is the arrangement of the units in the false twist texturing machine with automatic package doffs, so that a shortest possible yarn path and a very compact construction are realized for forming a servicing aisle and a doffing aisle of the type in accordance with the invention. From its unwinding in the creel to its winding, the yarn is guided without crossing its path.

What is claimed is:

1. A yarn false twist texturing apparatus for false twist texturing a plurality of synthetic yarns, comprising a plurality of side by side processing stations, with each station comprising a plurality of feed roll systems, a primary heater, a cooling device, a false twist unit, a secondary heater, and a takeup device, a takeup module mounting the takeup devices;

a processing module mounting the false twist units, said takeup module and said processing module being joined to form a frame section, with the frame section being arranged between a doffing aisle which is adjacent the takeup module and a servicing aisle which is adjacent the processing module, and wherein the plurality of feed roll systems are arranged so that the yarn being processed advances serially along the primary heater, the cooling device, the false twist unit, the secondary heater, and to the takeup device, and wherein the yarn advancing from the false twist unit along the secondary heater and to the takeup device forms a generally U-shaped path, and wherein the secondary heater of each processing station is generally horizontally oriented to form a base of said U-shaped path.

2. The yarn false twist texturing apparatus of claim 1 further comprising a feed module positioned on the side of said servicing aisle opposite said frame section, with said feed module mounting one of said plurality of feed roll systems of each of said processing stations, and such that a yarn passage from the feed module to the processing module is formed by the primary heater and the cooling device which are arranged above the servicing aisle such that the yarn is guided from the one feed roll system to the false twist unit along a substantially inverted V-shaped path.

3. The yarn false twist texturing apparatus of claim 1 wherein the secondary heater of each processing station is arranged adjacent the bottom of said frame section and is oriented so as to be inclined relative to the horizontal by an angle $\alpha$ of between about 50° and about 45°.

4. The yarn false twist texturing apparatus of claim 1 wherein one of said plurality of feed roll systems is mounted on the processing module between the false twist unit and an inlet end of the secondary heater, and with the one feed roll system and the inlet end being positioned so that the path of the yarn leaving the one feed roll system is aligned with the inlet end.

5. The yarn false twist texturing apparatus of claim 4 wherein a further one of said plurality of feed roll systems is mounted on the takeup module between the secondary heater and the takeup device, and with the further one of the feed roll systems being positioned so that the path of the yarn leaving an outlet end of the secondary heater is aligned with the point at which the yarn initially contacts the further one of the feed roll systems.

6. The yarn false twist texturing apparatus of claim 5 wherein each of the one feed roll system and the further one of the feed roll systems comprises a godet which is looped several times by the yarn, and a guide roll associated therewith, and with the godet being driven independently of the other feed roll systems.

7. The yarn false twist texturing apparatus of claim 1 wherein the secondary heater includes a heating channel, and an injector for threading the yarn through the heating channel.

8. The yarn false twist texturing apparatus of claim 7 wherein each processing station further comprises a threading device located between an outlet end of the secondary heater and the takeup device and including a further injector for threading the yarn in the takeup device.

9. The yarn false twist texturing apparatus of claim 1 wherein the primary heater and the cooling device of each processing station are arranged in a generally linear arrangement above the servicing aisle.

* * * * *